US011293273B2

(12) United States Patent
Malone et al.

(10) Patent No.: US 11,293,273 B2
(45) Date of Patent: Apr. 5, 2022

(54) METHOD AND APPARATUS FOR DOWNHOLE HEATING

(71) Applicant: ACCESSESP UK LIMITED, Great Yarmouth (GB)

(72) Inventors: David Malone, Houston, TX (US); Dwayne Leismer, Houston, TX (US); John Patterson, Commerce, TX (US); Rogelio Cantu, Houston, TX (US)

(73) Assignee: ACCESSESP UK LIMITED, Great Yarmouth (GB)

( * ) Notice: Subject to any disclaimer, the term of this patent is extended or adjusted under 35 U.S.C. 154(b) by 91 days.

(21) Appl. No.: 16/681,289

(22) Filed: Nov. 12, 2019

(65) Prior Publication Data

US 2020/0149379 A1 May 14, 2020

Related U.S. Application Data

(60) Provisional application No. 62/760,023, filed on Nov. 12, 2018.

(51) Int. Cl.

| | |
|---|---|
| ***E21B 43/24*** | (2006.01) |
| ***E21B 36/04*** | (2006.01) |
| *E21B 43/30* | (2006.01) |

(52) U.S. Cl.

CPC ..... *E21B 43/2401* (2013.01); *E21B 36/04* (2013.01); *E21B 43/305* (2013.01)

(58) Field of Classification Search

CPC ..... E21B 36/00; E21B 43/24; E21B 43/2401

See application file for complete search history.

(56) References Cited

U.S. PATENT DOCUMENTS

| | | | | |
|---|---|---|---|---|
| 6,353,706 B1 * | 3/2002 | Bridges | E21B 36/04 | 166/302 |
| 2002/0050361 A1 * | 5/2002 | Shaw | E21B 43/128 | 166/380 |
| 2011/0011596 A1 * | 1/2011 | Martinez | E21B 17/028 | 166/372 |

(Continued)

OTHER PUBLICATIONS

Salamander Solutions Inc. (Houston, Texas) "A Higher Degree of Production", 2017, salamandersolutions.com, accessed Nov. 6, 2018.

(Continued)

*Primary Examiner* — Tara Schimpf

(74) *Attorney, Agent, or Firm* — Gordon G. Waggett, P.C.

(57) ABSTRACT

A permanent completion system is disclosed comprising: an upper ACP installed in the wellbore powered by a first power cable from the surface; a lower ACP installed in the wellbore below the upper ACP, and being powered by a second power cable from the surface and being connected to the upper APC by a spacer tube; and a heating assembly connected to the lower ACP in the wellbore and receiving power from the second power cable, the heating assembly, such as a mineral insulated heater cable, providing heat to the wellbore. The heating assembly preferably is retrievable and can be conveyed to the lower ACP by coil tubing. The coil tubing can be removed after conveying the heating assembly into place to permit further access to the upper ACP, e.g., to permit mechanical and electrical connection of a retrievable ESP assembly to the upper ACP.

9 Claims, 6 Drawing Sheets

(56) References Cited

U.S. PATENT DOCUMENTS

| | | | | |
|---|---|---|---|---|
| 2013/0118746 | A1* | 5/2013 | Delp | F16L 11/127 166/302 |
| 2017/0204680 | A1* | 7/2017 | Leismer | E21B 43/128 |

OTHER PUBLICATIONS

Salamander Solutions Inc. (Houston, Texas) "Overview Presentation 'We Bring Low Cost Barrels'" May 22, 2018, salamandersolutions.com, accessed Nov. 6, 2018.
Salamander Solutions Inc. (Houston, Texas) "In-Well Data Sheet—MC069 Pipeline Data Sheet—MC069", 06/00/2018, salamandersolutions.com, accessed Nov. 6, 2018.
Salamander Solutions Inc. (Houston, Texas) "In-Well Data Sheet—MC080 Pipeline Data Sheet—MC080", 06/00/2018, salamandersolutions.com, accessed Nov. 6, 2018.
Salamander Solutions Inc. (Houston, Texas) "Pipeline Data Sheet—MC113 In-Well Data Sheet—MC113", 06/00/2018, salamandersolutions.com, accessed Nov. 6, 2018.
Salamander Solutions Inc. (Houston, Texas) "1-Introduction to Salamander Heaters: Dec. 2017", salamandersolutions.com, accessed Nov. 6, 2018.
Salamander Solutions Inc. (Houston, Texas) "2-Boostwell (TM) Application for Salamander Heaters: Feb. 2018", salamandersolutions.com, accessed Nov. 6, 2018.
Salamander Solutions Inc. (Houston, Texas) "3-Linkwell (TM) Application for Salamander Heaters: Oct. 2018", salamandersolutions.com, accessed Nov. 6, 2018.
Salamander Solutions Inc. (Houston, Texas) "Products", 2018, salamandersolutions.com, accessed Nov. 6, 2018.
Salamander Solutions Inc. (Houston, Texas) "BoostWell (TM)—Viscosity Improvement", 2018, salamandersolutions.com, accessed Nov. 6, 2018.

* cited by examiner

METHOD AND APPARATUS FOR DOWNHOLE HEATING

CROSS-REFERENCE TO RELATED APPLICATIONS

This application claims the benefit of the filing date of and priority to: U.S. Provisional Application Ser. No. 62/760,023 entitled "METHOD AND APPARATUS FOR DOWNHOLE HEATING" and filed Nov. 12, 2018, Confirmation No. 1091; said provisional application is incorporated by reference herein in its entirety for all purposes.

STATEMENT REGARDING FEDERALLY SPONSORED RESEARCH OR DEVELOPMENT

Not Applicable.

FIELD OF INVENTION

The present disclosure relates generally to downhole heating systems for boosting production in heavy oil wells. More specifically, the present disclosure is directed to the installation of a heater cable technology below a permanent downhole electrical connector system installed onto a permanent completion.

BACKGROUND OF THE INVENTION

Cold flow oil wells often produce oil at relatively low rates due to their low viscosity. A downhole pump, such as those provided in the retrievable ESP systems offered by AccessESP (Houston, Tex.), has to "pull hard" to enable flow, which also tends to pull in water high volumes of water, if present. Therefore, downhole heaters, such as those offered by Salamander Solutions (Houston, Tex.) are available to provide a small boost in temperature that will decrease the oil viscosity and simultaneously increase the oil production (by up to 5 times or more) and decrease water production. For example, a custom-designed Salamander BoostWell™ heater can be deployed in long horizontal cold flow wells to profitably increase oil production and provide this benefit for the life of the well: up to ten years or longer. Recent advances in drilling technology have enabled ever longer horizontal wells to be drilled enabling cold flow reservoirs that were formerly uneconomic to be developed. These long horizontal cold flow oil wells are ideal targets for the use of downhole heater technology, such as Salamander's BoostWell™ heater technology.

However, these downhole heaters require a source of electrical power. Currently, these downhole heating systems are deployed via coiled tubing and rely on power provided from the surface. For example, in a traditional permanent completion, these heaters can be deployed downhole through the completion using coiled tubing deployment. However, when the heater is in place, access to the well is limited, e.g., a retrievable ESP system cannot be installed into or retrieved from a permanent completion where such downhole heating systems have been installed. Therefore, there exists a need to provide for installation of a downhole heating system while still permitting access to the downhole permanent completion.

BRIEF SUMMARY OF THE INVENTION

In one embodiment, there is disclosed a heated downhole permanent completion system comprising: an upper annular connection port (ACP) installed in the wellbore; a first power cable directed from the surface to the upper ACP to provide electrical power to the upper ACP; a lower ACP installed in the wellbore below the upper ACP, and being connected to the upper ACP by a spacer tube; a second power cable directed from the surface to the lower ACP to provide electrical power to the lower ACP; and a heating assembly connected to the lower ACP in the wellbore and receiving power from the second power cable, the heating assembly providing heat to the wellbore.

The heating assembly preferably is retrievable and can be conveyed to the lower ACP by coil tubing.

In one embodiment, the heating assembly further comprises: a plug arm assembly for establishing a mechanical and an electrical connection between the retrievable heating assembly and the lower ACP, the plug arm assembly having an upper end connectable to the lower ACP and a lower end; a section of coil tubing connected to and extending from the lower end of the plug arm assembly, the section of coil tubing having an inner bore; and an electrical heating element within the section of coil tubing inner bore, the electrical heating element electrically connected to the lower ACP.

The electrical heating element may comprise a mineral insulated heater cable.

The heated downhole permanent completion system may further comprise a retrievable ESP assembly mechanically and electrically connected to the upper ACP.

There is also disclosed a method of heating a downhole permanent completion system comprising the steps of: installing an upper annular connection port (ACP) in the wellbore, the upper ACP being supplied with electrical power via a first power cable directed from the surface to the upper ACP; installing a lower ACP in the wellbore, the lower ACP being supplied with electrical power via a second power cable directed from the surface to the lower ACP, the lower ACP being installed in the wellbore below the upper ACP, and being connected to the upper ACP by a spacer tube; conveying a heating assembly into the wellbore and mechanically and electrically connecting the heating assembly to the lower ACP in the wellbore; and generating heat from the electrical heating assembly into the wellbore. In this method, the heating assembly may be conveyed into the wellbore via coil tubing. When coil tubing is used to convey the electrical heating assembly to the lower ACP, the coil tubing may thereafter be removed from the wellbore after the step of installing the electrical heating assembly to permit further access to the upper ACP, for example, to permit mechanically and electrically connecting a retrievable ESP assembly to the upper ACP.

In this method, the heating assembly may be retrievable, and be conveyed by coil tubing.

In one embodiment of the present method, the heating assembly further comprises: a plug arm assembly for establishing a mechanical and an electrical connection between the retrievable heating assembly and the lower ACP, the plug arm assembly having an upper end connectable to the lower ACP and a lower end; a section of coil tubing connected to and extending from the lower end of the plug arm assembly, the section of coil tubing having an inner bore; and an electrical heating element within the section of coil tubing inner bore, the electrical heating element electrically connected to the lower ACP. The electrical heating element may comprise a mineral insulated heater cable.

DETAILED DESCRIPTION OF THE INVENTION

Reference is now made to the drawings which depict various embodiments of the present disclosure, but are not drawn to scale.

Electrical submersible pump (ESP) systems 300 require connection to an electric power supply, which drives the motor (not specific to motor type). Conventional ESPs typically use electrical connectors that are assembled manually—these are simple plug and socket type connections, which must be fitted in a controlled environment.

In a conventional ESP application (tubing deployed ESP), the electrical power is supplied to the electric motor from a surface variable speed drive (VSD) via an ESP cable. The ESP cable is installed onto the production tubing during the ESP installation and it is normally terminated in a motor lead extension (MLE) which incorporates a pothead. The pothead is connected to the motor during the installation. The ESP system is installed on the end of the tubing, hence the term "tubing deployed ESP".

In case of a retrievable ESP system, such as those offered by AccessESP, a permanent completion is installed and then the ESP cable is installed onto the production tubing and onto the ESP permanent completion and it connects to the permanent downhole wet connector (fixed end). The motor and pump system is typically deployed inside the production tubing using slickline (SL) and the electrical connection to the permanent completion is performed at depth. The electrical power is transferred to the motor through the retrievable connector (plug head), when the retrievable connector is connected to the permanent downhole wet connector.

Figure 1:
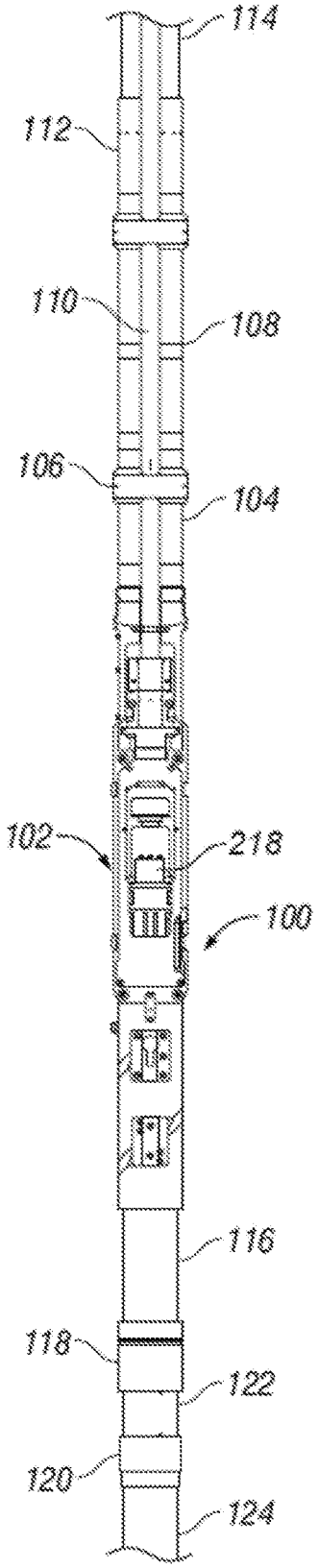
FIG. 1 is a general plan view of a typical production tubing installation of a permanent completion section of a retrievable ESP system.

FIG. 1 illustrates a portion of a production tubing string assembly 100 comprising upper production tubing section 114 which leads to surface (not shown) and a lower production tubing section 124. This is a general view of a typical production tubing installation 100 of the permanent completion section of a retrievable ESP system. Production tubing 100 further comprises an annular connection port (ACP) section 102 connected between the upper and lower production tubing strings (114, 124). The ACP 102 annular connection port top level assembly employs a side pocket style wet connector system. An ESP cable 110 runs down the production tubing assembly 100 from the surface to the ACP. The ESP cable 110 could be any style cable known in the art, including one or more individually protected cable or cables embedded within a cable housing. A gas venting coupling 112 is employed to allow gas build-up from ESP system to escape to the annulus. A shroud joint 104 is provided for retrievable components of a retrievable ESP system. A cable protector split clamp 106 is provided to fix and protect ESP and other cables going down the assembly. A centralizer coupling 108 is shown. A spacer joint 116 is shown to provide spacing for a B-profile coupling 118, a coupling with an internal B-profile to release the alignment pin on a retrievable system. A no-go coupling 120 is shown, and serves as a coupling with an undersized ID to provide a hard-stop for depth indication. Another spacer joint 122 spaces the no-go coupling 120 from the B-profile coupling 118.

Figure 2:
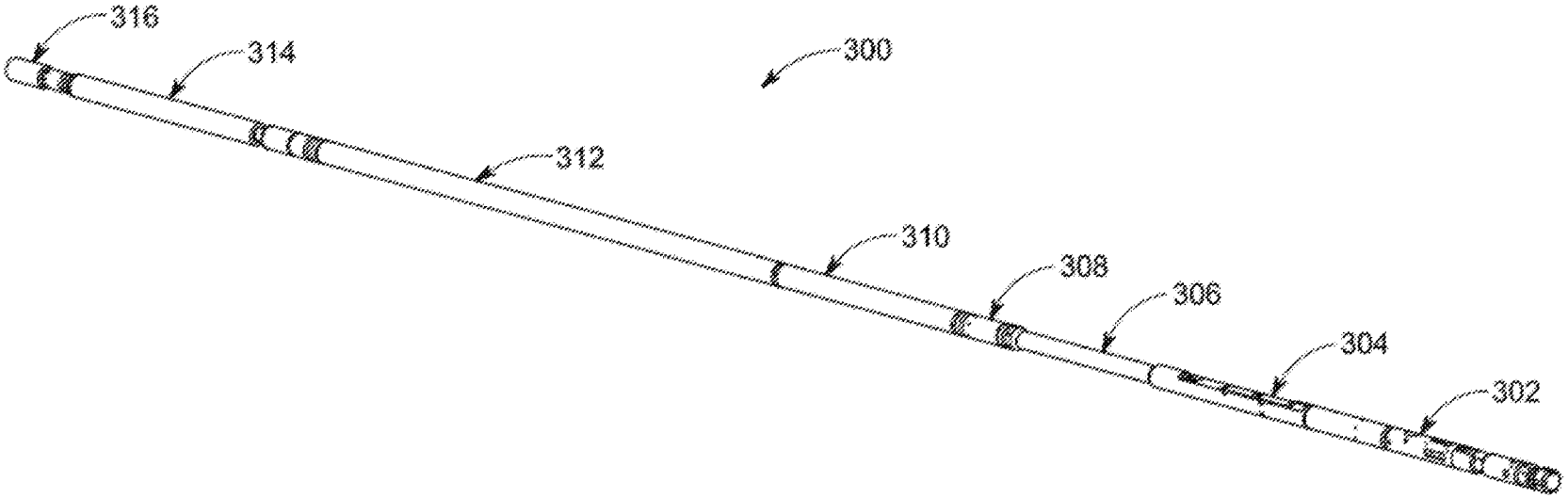
FIG. 2 is a perspective view generally depicting an exemplary standard retrievable ESP assembly.

FIG. 2 generally depicts an exemplary standard retrievable ESP assembly 300 comprising at one end a lower mating unit 316 for forming a retrievable system to pump connection. An industry standard motor protector/seal section 314 is provided adjacent to the lower mating unit 316 between the motor 312, such as a permanent magnet motor (PMM) or other suitable motor (e.g., brushless electrical motor), and a downhole sensor system 310 connected adjacent to the PMM for downhole wellbore fluid pressure, temperature and motor winding temperature and motor vibration measurement. A pressure balancing and connector section 308 (pressure balance assembly) is provided to connect the motor and sensor system to the plug arm assembly 306 (e.g., to a pressure compensated female connector system), which is in turn connected to the plug head assembly 304 (or female connector assembly). A plug arm orienting section 302 is provided and includes the retrievable system orienting pin, the plug head release mechanism and the emergency release.

Figure 3:
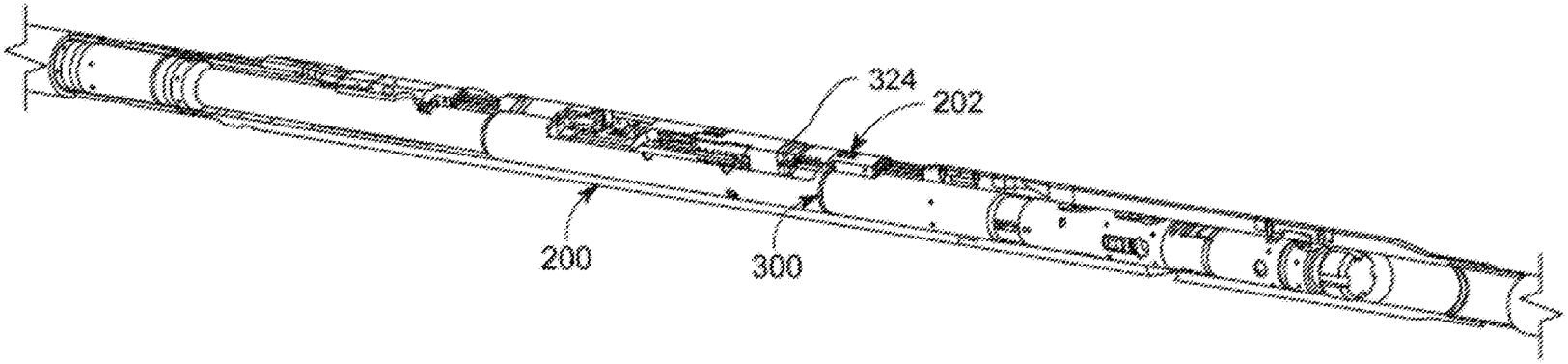
FIG. 3 is a perspective cut-away view of a partial length of an exemplary permanent completion portion of a production tubing assembly shown with a standard retrievable ESP assembly connected to the annular connection port (also referred to herein as an ACP) connection section via a permanent downhole electrical connector assembly.

FIG. 3 depicts a partial length of a permanent completion portion of a production tubing assembly shown with a retrievable ESP assembly 300 connected to the permanent downhole ACP connector section 200 via connecting the test female connector assembly 324 of the ESP assembly to a permanent downhole electrical connector assembly 202 of the ACP according to an embodiment of the present disclosure.

Figure 4:
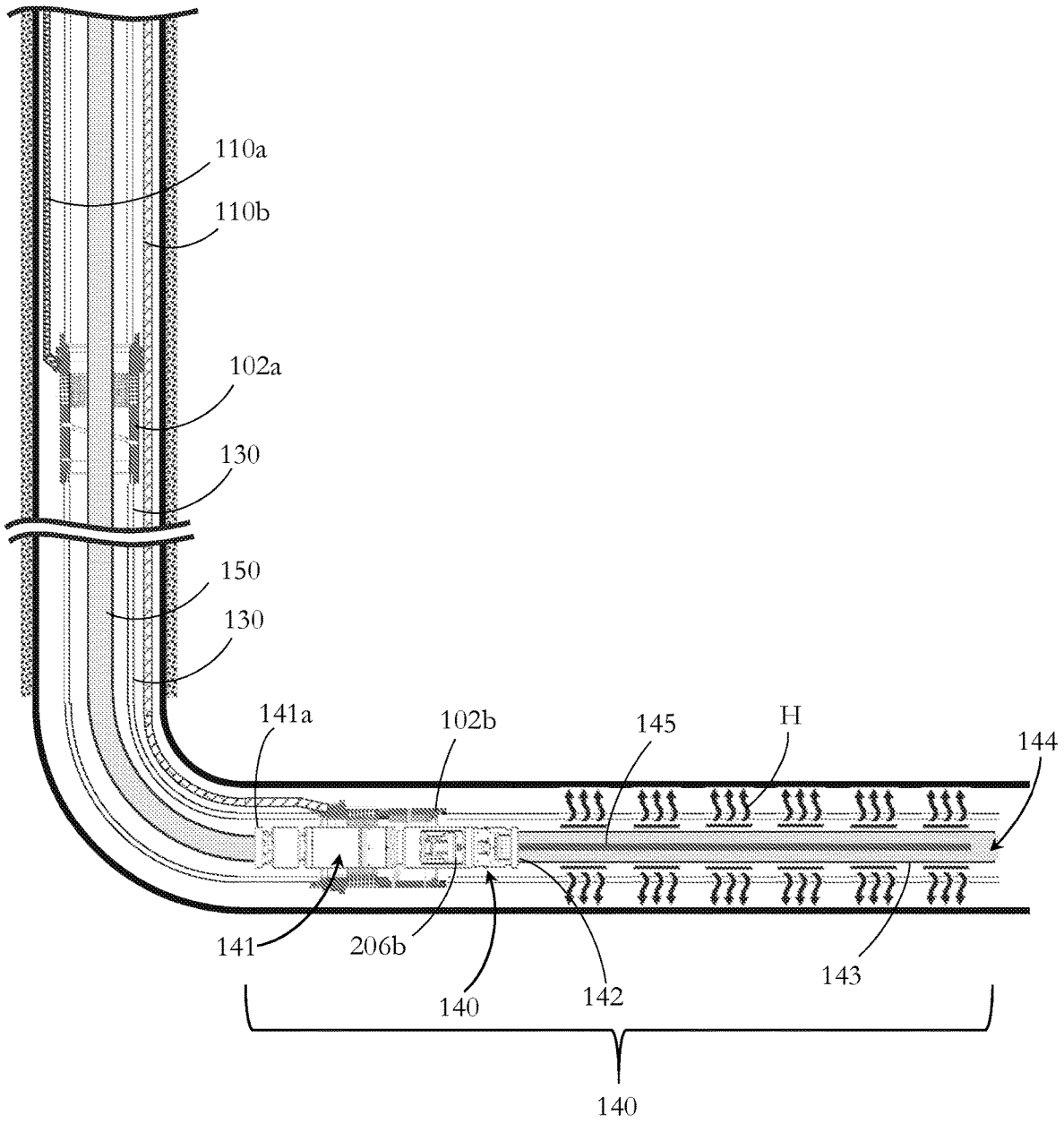
FIG. 4 illustrates a well completion which includes separate upper and lower ACP docking mandrels, with a coiled tubing deployed heater connected to the lower ACP docking mandrel to receive power according to one of more embodiments of the present disclosure.

FIG. 4 illustrates a well completion which includes separate upper ACP docking mandrel 102*a* (capable of receiving a retrievable assembly and creating an electrical connection therewith via a downhole electrical connector assembly/wet mate connector not shown capable of connecting with a corresponding connector assembly on the retrievable tool) and lower ACP docking mandrel 102*b* (capable of receiving a retrievable assembly and creating an electrical connection therewith via a downhole electrical connector assembly/wet mate connector 206*b* capable of connecting with a corresponding connector assembly on the retrievable tool). The upper ACP 102*a* receives its power from surface via electrical power cable 110*a*. The lower ACP 102*b* receives its power from surface via another, separate electrical power cable 110*b*. The lower ACP 102*b* is installed in the permanent completion below the upper ACP 102*a* via a suitable length of spacer tube 130. At this stage of the permanent completion, each ACP docking mandrel is capable of receiving a retrievable tool and making an electrical connection therewith.

A coil tubing deployed retrievable heater assembly 140 is provided that can be deployed by coil tubing 150 for connection to the lower ACP 102*b* and for electrical connection to the power cable 110*b* via a lower wet mate connection 206*b*. The heater assembly 140 has at its upper end a plug arm assembly 141 with a suitable coil tubing adapter/fishing head 141*a* for releasable connection of the lower end of the deployable coil tubing 150 to the upper end of the heater assembly 140. The heating assembly 140 also employs an electrical connection (of a similar type used in making standard retrievable ESP plug arm assembly downhole wet mate connections 206*b*) to permit the heating assembly 140 to obtain connection to the surface power provided to the lower ACP 102*b* via power cable 110*b*. At the opposite end of the retrievable heating assembly 140 is a coil tubing adapter 142 connecting a desired length of a lower coil tubing section 143. Contained within the inner bore 144 of the lower coil tubing section 143 is an electric heating element 145 electrically interfaced with the lower ACP 102*b* electrical power supply 110*b*. The heating element 145 is capable of radially directing heat H into the surrounding wellbore.

AS indicated, FIG. 4 represents a well completion which includes two separate ACP mandrels (docking mandrels) 102*a*, 102*b* using each a separate ESP cable 110*a*, 110*b*. A heating unit 145 is attached to the plug-arm assembly 141 electrically as well as mechanically in order to use the power coming from the ESP cable 110*b*. This heater 145 is placed inside a coil tubing section 143 which is also attached below the plug-arm assembly 141. This lower plug-arm assembly/heater apparatus 140 is running in coiled tubing via an upper adapter. This embodiment depicts a novel deployment method for a downhole heater. A downhole heater is desirable in certain conditions when cold temperatures make oil production difficult by increasing the viscosity of the oil being produced or by the formation of hydrates which clog the tubing and therefore restrict or prevent the free flow of oil to surface. The deployment method depicted uses an ACP 102*b* and plug arm assembly 141 as the means to power the downhole heater 145. This allows to have a heater 145 downhole while still having full bore access above it for the installation of an ESP system to favour oil production.

Exemplary electric downhole heating elements 145 are known in the art and include those provided by, e.g., Salamander Solutions (Houston, Tex.) to provide a small boost in temperature that will decrease the oil viscosity and simultaneously increase the oil production (by up to 5 times or more) and decrease water production. For example, a custom-designed Salamander BoostWell™ heater or mineral insulated heater cables known in the art (such as those offered by Salamander) can be deployed in long horizontal cold flow wells to profitably increase oil production. A typical mineral insulated heater cable comprises an internal conductor core of, e.g., copper conductor material or other heater element. A layer of mineral insulation surrounds the core, e.g., a layer of magnesium oxide insulation. An outer stainless steel sheath surrounds the mineral insulation layer.

Figure 5:
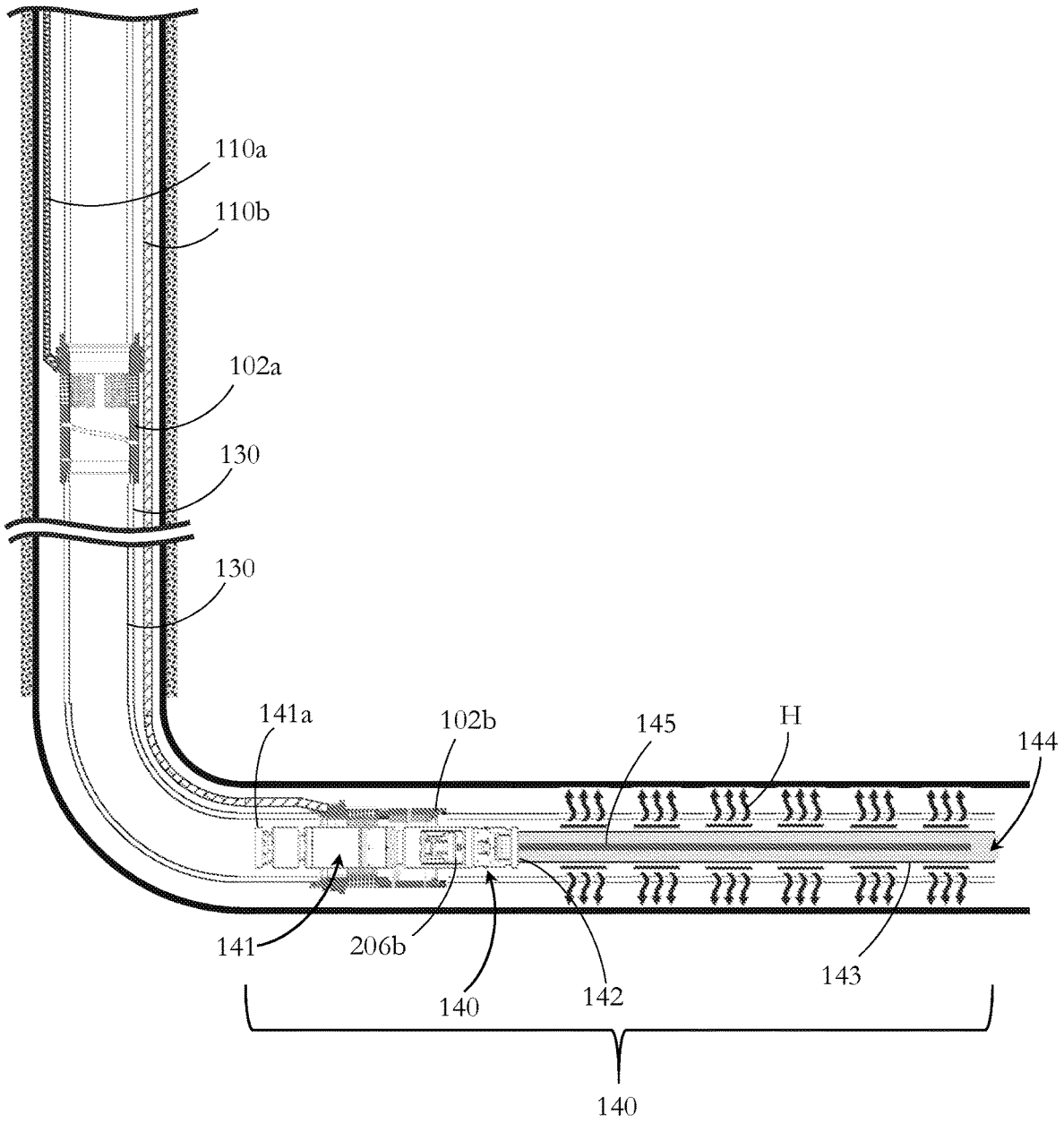
FIG. 5 illustrates a well completion which includes separate upper and lower ACP docking mandrels, with a coiled tubing deployed heater connected to the lower ACP docking mandrel to receive power, and wherein the coiled tubing has now been removed according to one of more embodiments of the present disclosure.

As illustrated in FIG. 5, after coil tubing conveyed installation of the heating assembly into the lower portion of the completion (FIG. 4), the coil tubing 150 used to deploy the heating assembly 140 may be removed, leaving an open bore access through the upper ACP 102*a*.

Figure 6:
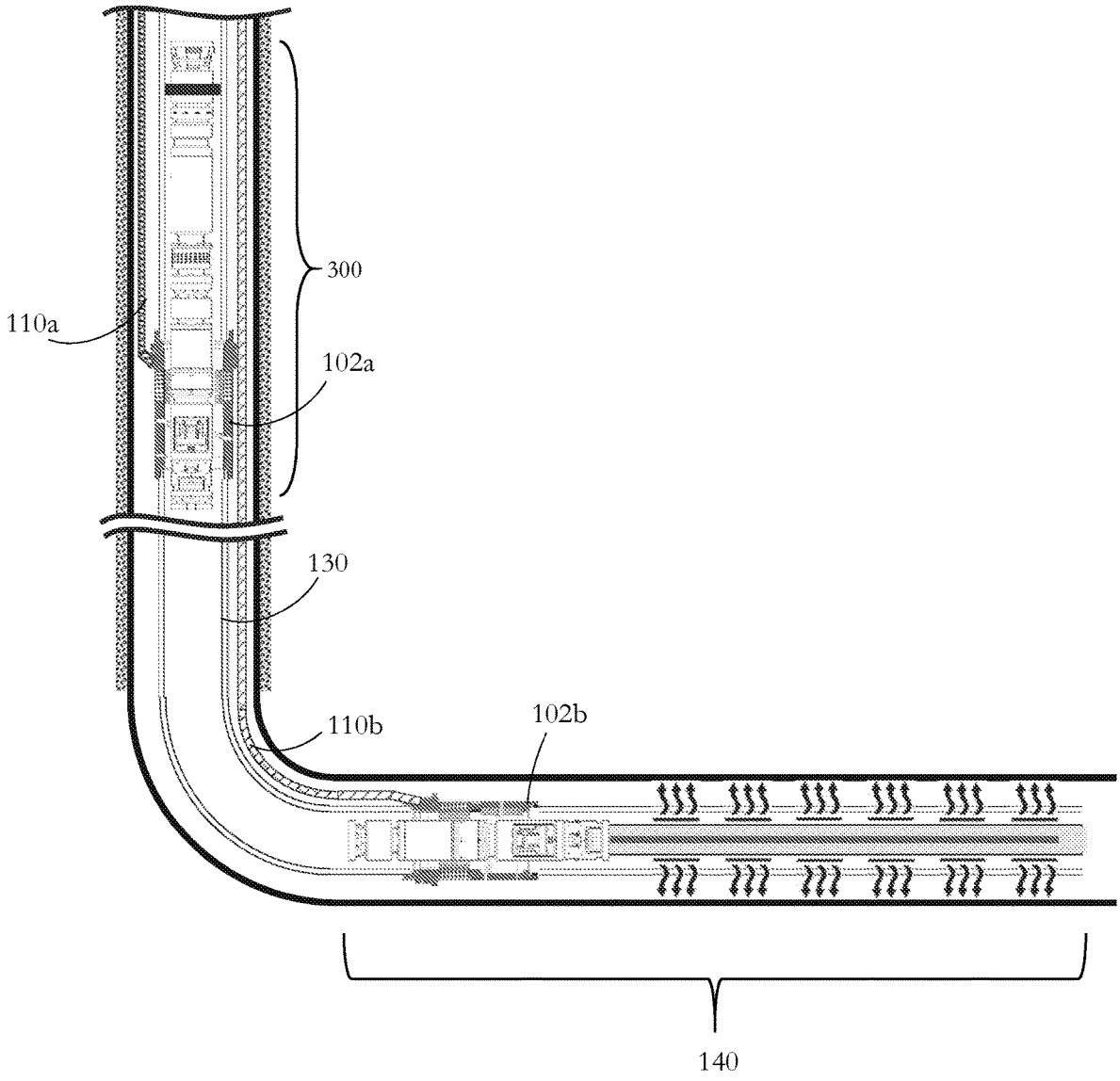
FIG. 6 illustrates a well completion which includes separate upper and lower ACP docking mandrels, with a coiled tubing deployed heater connected to the lower ACP docking mandrel to receive power, and wherein the coiled tubing has now been removed according to one of more embodiments of the present disclosure.

Once the coil tubing is removed (FIG. 5), the upper ACP 102*a* is then available to receive, e.g., a standard retrievable ESP 300 (as shown in FIG. 6) while still permitting concurrent operation of the downhole heater assembly 140.

While the apparatus and methods of this invention have been described in terms of preferred embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art. While the apparatus and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A heated downhole permanent completion system comprising:

a. an upper annular connection port (ACP) installed in the wellbore, b. a first power cable directed from the surface to the upper ACP to provide electrical power to the upper ACP;

c. a lower ACP installed in the wellbore below the upper ACP, and being connected to the upper ACP by a spacer tube;

d. a second power cable directed from the surface to the lower ACP to provide electrical power to the lower ACP;

e. a retrievable heating assembly connected to the lower ACP in the wellbore and receiving power from the second power cable, the heating assembly providing heat to the wellbore and further comprising i. a plug arm assembly for establishing a mechanical and an electrical connection between the retrievable heating assembly and the lower ACP, the plug arm assembly having an upper end connectable to the lower ACP and a lower end;

ii. a section of coil tubing connected to and extending from the lower end of the plug arm assembly, the section of coil tubing having an inner bore; and iii. an electrical heating element within the section of coil tubing inner bore, the electrical heating element electrically connected to the lower ACP.

2. The heated downhole permanent completion system of claim 1 wherein the retrievable heating assembly is conveyed to the lower ACP by coil tubing.

3. The heated downhole permanent completion system of claim 1 wherein the electrical heating element comprises a mineral insulated heater cable.

4. The heated downhole permanent completion system of claim 1 further comprising a retrievable electrical submersible pump (ESP) assembly mechanically and electrically connected to the upper ACP.

5. A method of heating a downhole permanent completion system comprising the steps of:

a. installing an upper annular connection port (ACP) in the wellbore, the upper ACP being supplied with electrical power via a first power cable directed from the surface to the upper ACP;

b. installing a lower ACP in the wellbore, the lower ACP being supplied with electrical power via a second power cable directed from the surface to the lower ACP, the lower ACP being installed in the wellbore below the upper ACP, and being connected to the upper ACP by a spacer tube;

conveying a retrievable heating assembly into the wellbore and mechanically and electrically connecting the heating assembly to the lower ACP in the wellbore, wherein the heating assembly further comprises:

i. a plug arm assembly for establishing a mechanical and an electrical connection between the retrievable heating assembly and the lower ACP, the plug arm assembly having an upper end connectable to the lower ACP and a lower end;

ii. a section of coil tubing connected to and extending from the lower end of the plug arm assembly, the section of coil tubing having an inner bore; and iii. an electrical heating element within the section of coil tubing inner bore, the electrical heating element electrically connected to the lower ACP; and c. generating heat from the electrical heating assembly into the wellbore.

6. The method of claim 5 wherein the heating assembly is conveyed into the wellbore via coil tubing.

7. The method of claim 6 wherein the coil tubing is removed from the wellbore after the step of mechanically and electrically connecting the electrical heating assembly.

8. The method of claim 7 further comprising the step of mechanically and electrically connecting a retrievable electrical submersible pump (ESP) assembly to the upper ACP.

9. The method of claim 5 wherein the electrical heating element comprises a mineral insulated heater cable.

* * * * *